US009083108B2

(12) United States Patent
Adachi et al.

(10) Patent No.: US 9,083,108 B2
(45) Date of Patent: Jul. 14, 2015

(54) WATERPROOF ELECTRICAL CONNECTOR

(75) Inventors: Hideomi Adachi, Kosai (JP); Hidehiko Kuboshima, Kosai (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/642,315

(22) PCT Filed: Apr. 18, 2011

(86) PCT No.: PCT/JP2011/059553

§ 371 (c)(1),
(2), (4) Date: Nov. 27, 2012

(87) PCT Pub. No.: WO2011/132643

PCT Pub. Date: Oct. 27, 2011

(65) Prior Publication Data

US 2013/0065430 A1 Mar. 14, 2013

(30) Foreign Application Priority Data

Apr. 20, 2010 (JP) ..... 2010-096666

(51) Int. Cl.
*H01R 13/52* (2006.01)
*H01R 13/53* (2006.01)
*H01R 13/436* (2006.01)

(52) U.S. Cl.
CPC ..... *H01R 13/521* (2013.01); *H01R 13/5216* (2013.01); *H01R 13/4361* (2013.01); *H01R 13/53* (2013.01)

(58) Field of Classification Search
USPC ..... 439/521, 752, 459, 460, 465, 474
IPC ..... H01R 13/58,13/5804, 13/5812, 13/582, H01R 13/5825, 13/5829
See application file for complete search history.

(56) References Cited

U.S. PATENT DOCUMENTS 5,885,114 A 3/1999 Akeda et al.
6,027,374 A * 2/2000 Nagai et al. ..... 439/596
(Continued)

FOREIGN PATENT DOCUMENTS

EP 0660447 A1 6/1995
EP 2169772 A1 3/2010
(Continued)

OTHER PUBLICATIONS

International Search Report dated May 17, 2011 from the International Searching Authority in counterpart international application No. PCT/JP2011/059553.
(Continued)

*Primary Examiner* — Vanessa Girardi
(74) *Attorney, Agent, or Firm* — Sughrue Mion, PLLC

(57) ABSTRACT

Provided is a connector capable of preventing an operator from touching a filler and reducing a filling amount of a filler to cut down the cost. A connector (1) includes a terminal fitting (3) provided at an end of a high-voltage electric wire (2), and a connector housing (4) that has a terminal accommodation part (14) that contains the terminal fitting (3). The connector (1) is waterproofed by a filler (A) with which a filling chamber (15) in the connector housing (4) is filled. The connector (1) includes a holder (5) that is fitted to the connector housing (4) and that engages with the high-voltage electric wire (2) which is drawn from the filling chamber (15). A rib (26) is integrally formed with the holder (5), and provided across an opening of the filling chamber (15) and a part of the rib (26) is partly immersed in the filler.

5 Claims, 5 Drawing Sheets

(56) References Cited

U.S. PATENT DOCUMENTS

| | | | | |
|---|---|---|---|---|
| 6,094,813 | A | 8/2000 | Akeda et al. | |
| 7,059,918 | B2 * | 6/2006 | Matsumoto et al. | 439/752 |
| 8,246,369 | B2 | 8/2012 | Okayasu et al. | |
| 2006/0121773 | A1 | 6/2006 | Ichikawa et al. | |
| 2010/0075522 | A1 | 3/2010 | Okayasu et al. | |

FOREIGN PATENT DOCUMENTS

| | | | |
|---|---|---|---|
| JP | 2713846 | B2 | 10/1997 |
| JP | 2003317876 | A | 11/2003 |
| JP | 200526102 | A | 1/2005 |
| JP | 200612744 | A | 1/2006 |
| JP | 2006156052 | A | 6/2006 |
| JP | 201080202 | A | 4/2010 |

OTHER PUBLICATIONS

Written Opinion dated May 17, 2011 from the International Searching Authority in counterpart international application No. PCT/JP2011/059553.

Communication from the Japanese Patent Office dated Feb. 25, 2014, in a counterpart Japanese application No. 2010-096666.

European Search Report issued May 22, 2014, in corresponding Application No. 11771978.1.

Office Action, dated Jul. 18, 2014, issued by the State Intellectual Property Office of the People's Republic of China in counterpart Patent Application No. 201180020310.4.

Office Action, Issued by the State Intellectual Property Office of P.R. China, Dated Mar. 18, 2015, in counterpart Chinese Application No. 201180020310.4.

* cited by examiner

WATERPROOF ELECTRICAL CONNECTOR

TECHNICAL FIELD

The present invention relates to a connector which is waterproofed using a curable filler.

BACKGROUND ART

Patent Literatures 1 to 3 disclose a connector which is waterproofed by using a filler and curing the filler, for example. According to the connector disclosed in Patent Literatures 1 to 3, a connector housing configuring the connector is formed with a filling chamber for filling the filler. The filler is filled into the filling chamber and then cured. In a cured state, it is possible to prevent infiltration of moisture, etc., to an electrical connection part via an electric wire.

CITATION LIST

Patent Literature

Patent Literature 1: Japanese Patent No. 2713846
Patent Literature 2: JP-A-2003-317876
Patent Literature 3: JP-A-2006-156052

SUMMARY OF INVENTION

Technical Problem

In the existing connector which is waterproofed by using the filler, since it takes some time for the filler to be cured, following risks may be caused during the curing. That is, in a case where it is necessary to form a large opening in a filling chamber (for example, refer to a filling chamber disclosed in Patent Literature 3), an operator may accidentally put a finger into the filling chamber, for example, so that the finger may touch the filler before being cured. Accordingly, there is a room for improvement in the existing connector. Meanwhile, in a case where improvement is made in such a way that a cover is provided to cover the filling chamber, since the filling chamber is hidden by the cover, it is difficult to confirm whether the filler is completely cured or not. Accordingly, it can be said that such an improvement is insufficient.

Further, the existing connector has a problem that the cost is increased as a filling amount of the filler increases, in a case where the filler is relatively expensive.

The present invention has been made to solve the above-described problems, and an object of the present invention is to provide a connector capable of preventing an operator from touching a filler. Another object of the present invention is to provide a connector capable of reducing a filling amount of a filler to thus cut down the cost.

Solution to Problem

The above object of the present invention is achieved by following configurations.

(1) A connector, including: a terminal fitting provided at an end of an electric wire; and a connector housing including a terminal accommodation part in which the terminal fitting is accommodated, wherein the connector is to be waterproofed by a filler filled into a filling chamber of the connector housing, the filling chamber is arranged to allow at least a wire connection part and a continuous part which is continuous to an electrical contact part and continuous to the wire connection part in the terminal fitting to be immersed in the filler, and the connector further includes a holder fitted in the connector housing and engaged with the electric wire which is drawn from the filling chamber, wherein a rib is formed integrally with the holder, the rib being provided across an opening of the filling chamber and partly being immersed in the filler.

According to the connector having the configuration (1) mentioned above, since the rib is formed in the holder, it is possible to prevent an operator's finger from touching the filler. Further, according to the configuration (1) mentioned above, since the rib is provided and therefore the opening of the filling chamber is not entirely covered, the filler is visible so that it is possible to confirm whether the filler is completely cured or not. Further, according to the configuration (1) mentioned above, since a portion of the rib is partly immersed in the filler, it is possible to reduce the filling amount of the filler by an amount corresponding to the immersed part.

(2) The connector according to the configuration (1), wherein the rib is formed to extend to a position corresponding to the continuous part or the wire connection part, and an extension part is integrally formed with the rib, the extension part extending from the partly immersed portion of the rib toward a bottom of the filling chamber so as to contact the continuous part or the wire connection part.

According to the connector having the configuration (2) mentioned above, it is possible to detect that the terminal fitting is in a incomplete-fitting state with respect to the terminal accommodation part if the extension part is brought into contact with the terminal fitting when the holder is fitted into the connector housing. Further, according to the configuration (2) mentioned above, it is possible to reduce the filling amount of the filler by a protruding amount of the extension part.

MODES FOR CARRYING OUT INVENTION

Hereinafter, a connector according to an embodiment of the present invention will be described with reference to the accompanying drawings.

Figure 5:
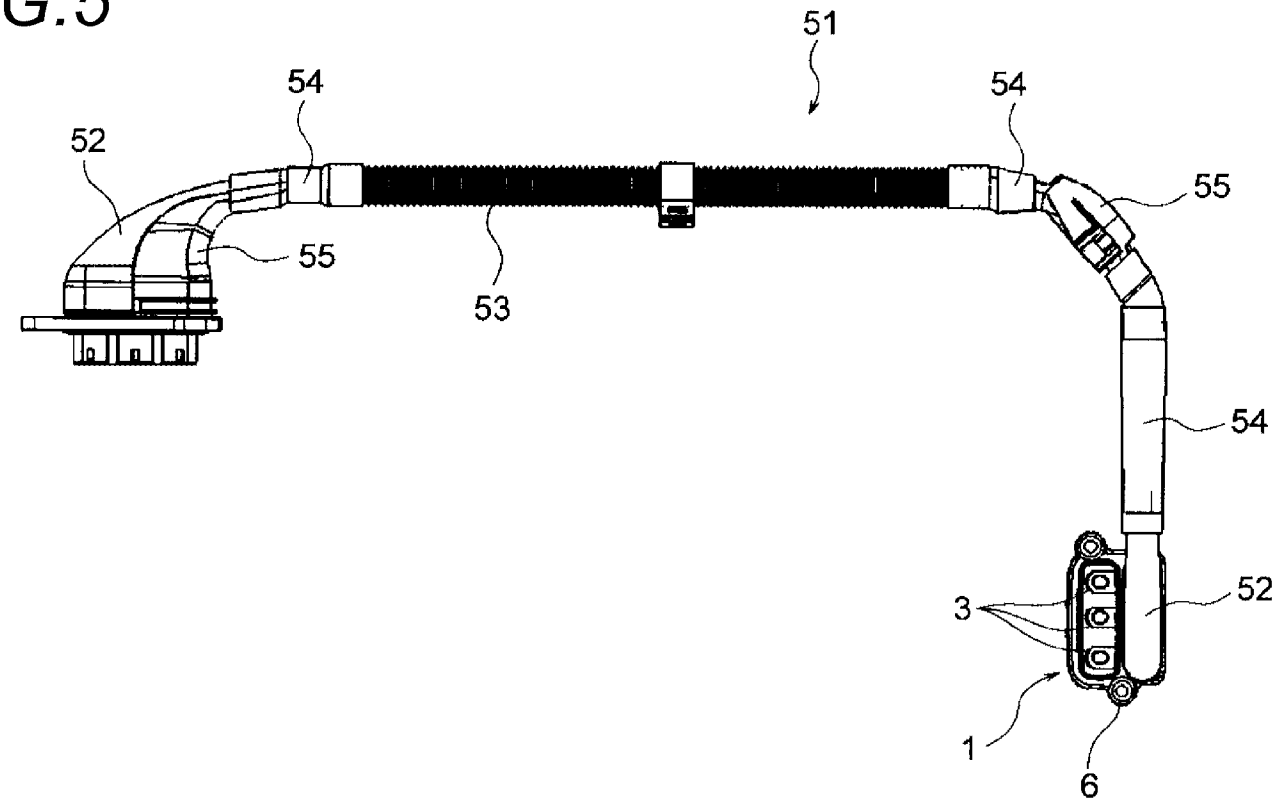
FIG. 5 is a schematic view of a wire harness including the connector shown in FIG. 1.

As shown in FIG. 5, a connector 1 according to the present embodiment is provided at one end of a wire harness 51 (the wire harness 51 is described as an example). In FIG. 5, the wire harness 51 is intended for use in high voltage and includes three high-voltage electric wires 2 (see FIG. 1) which are covered with a braid 52 in group. Protective members such as a corrugated tube 53, a cylinder member 54 and a protector 55 are provided on an outer side of the braid 52. In the below, the connector 1 is described.

Figure 1:
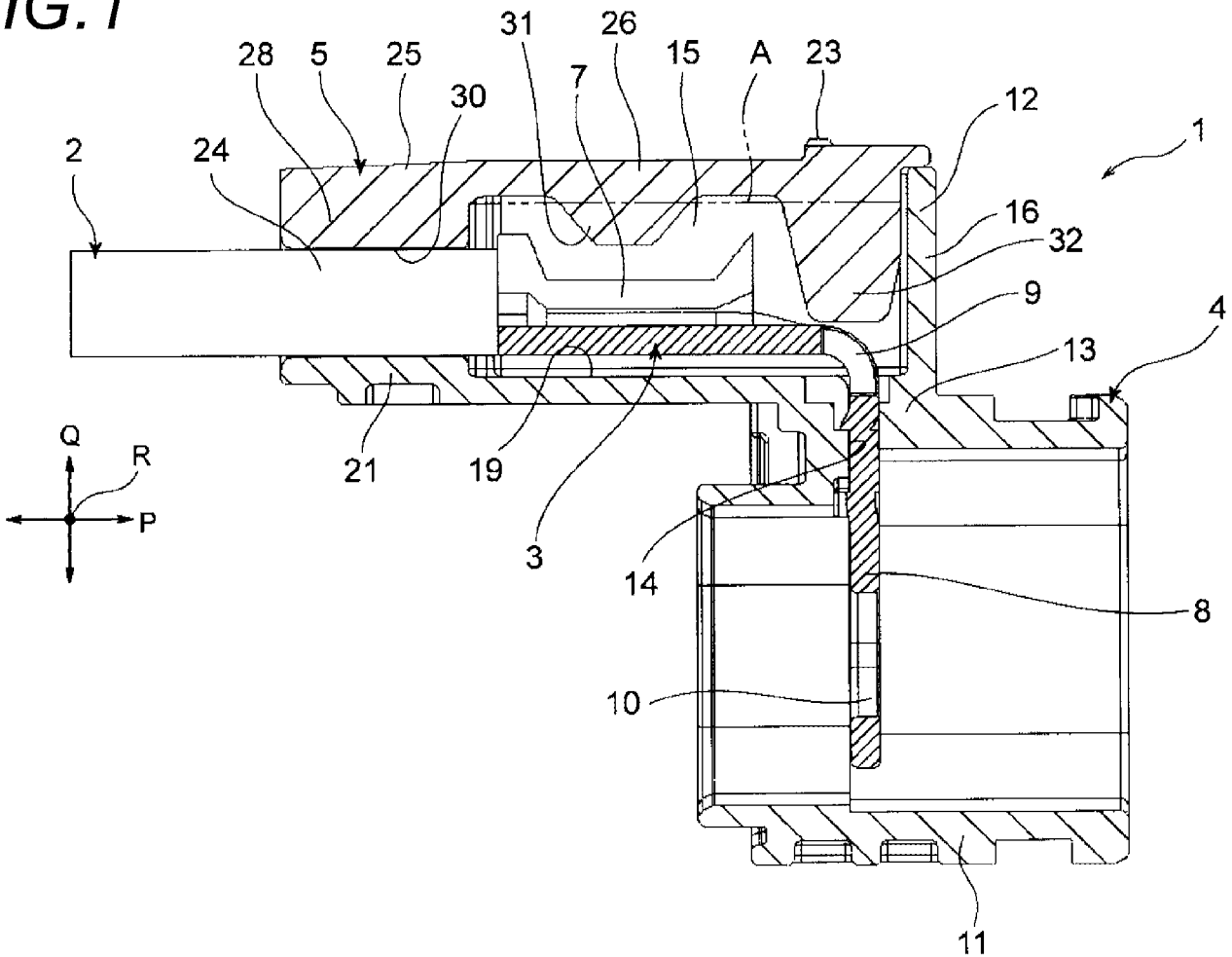
FIG. 1 is a longitudinal cross-sectional view showing a connector according to an embodiment of the present invention.

In FIG. 1, the connector 1 is intended for use in high voltage and configured as a relatively large connector. The connector 1 includes a conductive terminal fitting 3 provided at an end of each high-voltage electric wire 2 (electric wire), a connector housing 4 made of insulation resin, a resin holder 5 fitted into the connector housing 4 and a metal fixed part 6 (see FIG. 5)

which is fixed to a mating housing, for example. The connector 1 has been subjected to a waterproofing (waterproofing will be described later).

The terminal fitting 3 includes a wire connection part 7 to which the end of the high-voltage electric wire 2 is connected and an electrical contact part 8 which is brought into contact and connected with a mating terminal (not shown). The terminal fitting 3 has such a shape that a continuous part 9 extended between the wire connection part 7 and the electrical contact part 8 is bent at a substantially right angle and thus forms L-shape. The wire connection part 7 is formed so that the conductor of the high-voltage electric wire 2 can be connected to the wire connection part 7 by crimping. Bolt insertion through-holes 10 are formed at predetermined positions of the electrical contact part 8. A fitting part (a reference numeral thereof is omitted) for a terminal accommodation part 14 (which will be described later) of the connector housing 4 is formed between the bolt insertion through-holes 10 and the continuous part 9. The fitting part is a small claw-like protrusion and formed in plural. The fitting part is fitted into the terminal accommodation part 14, so that the terminal fitting 3 is prevented from being separated. On the other hand, when the fitting part is not completely fitted into the terminal accommodation part 14, an incomplete-fitting state is caused. The incomplete-fitting state can be mentioned as the cause of failure such as separation. In the present embodiment, the incomplete-fitting state can be detected, which will be described later.

Figure 2:
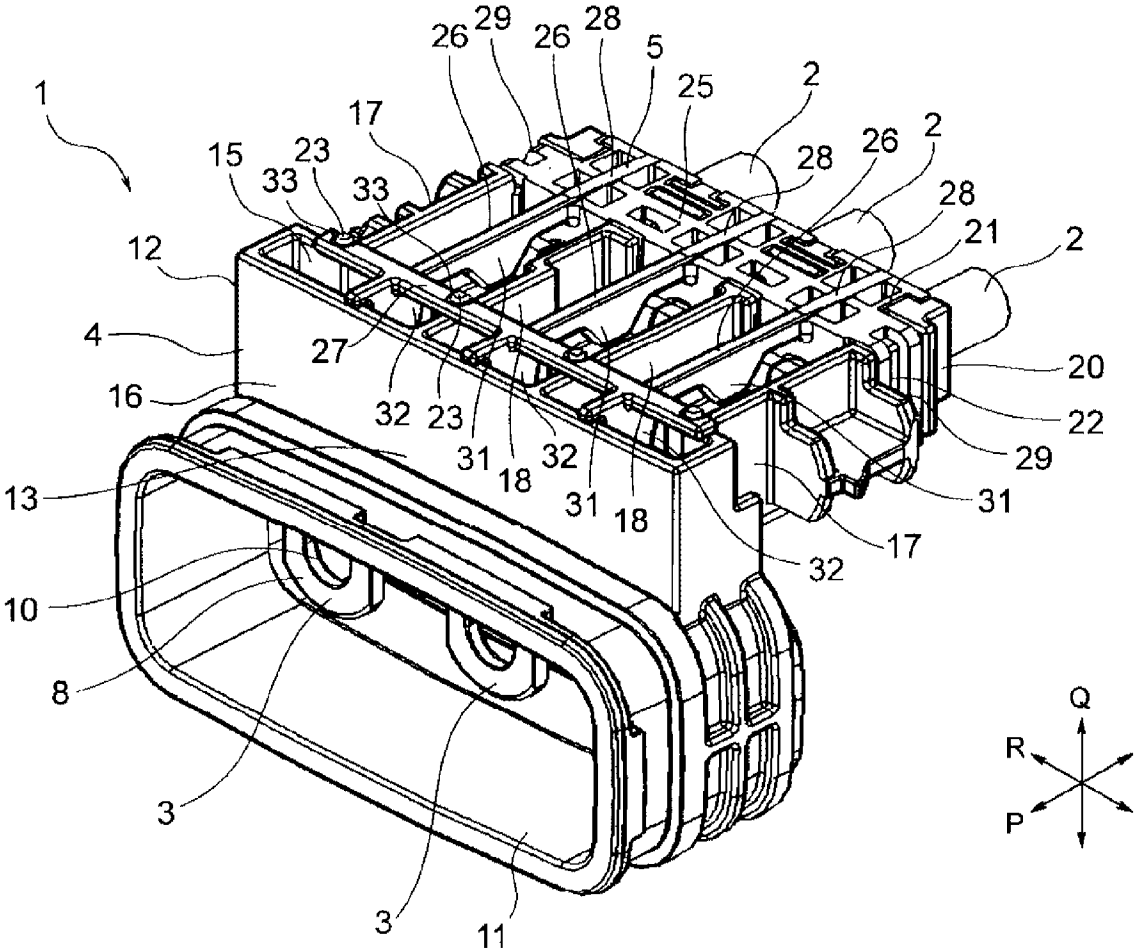
FIG. 2 is a perspective view of the connector shown in FIG. 1.
Figure 3:
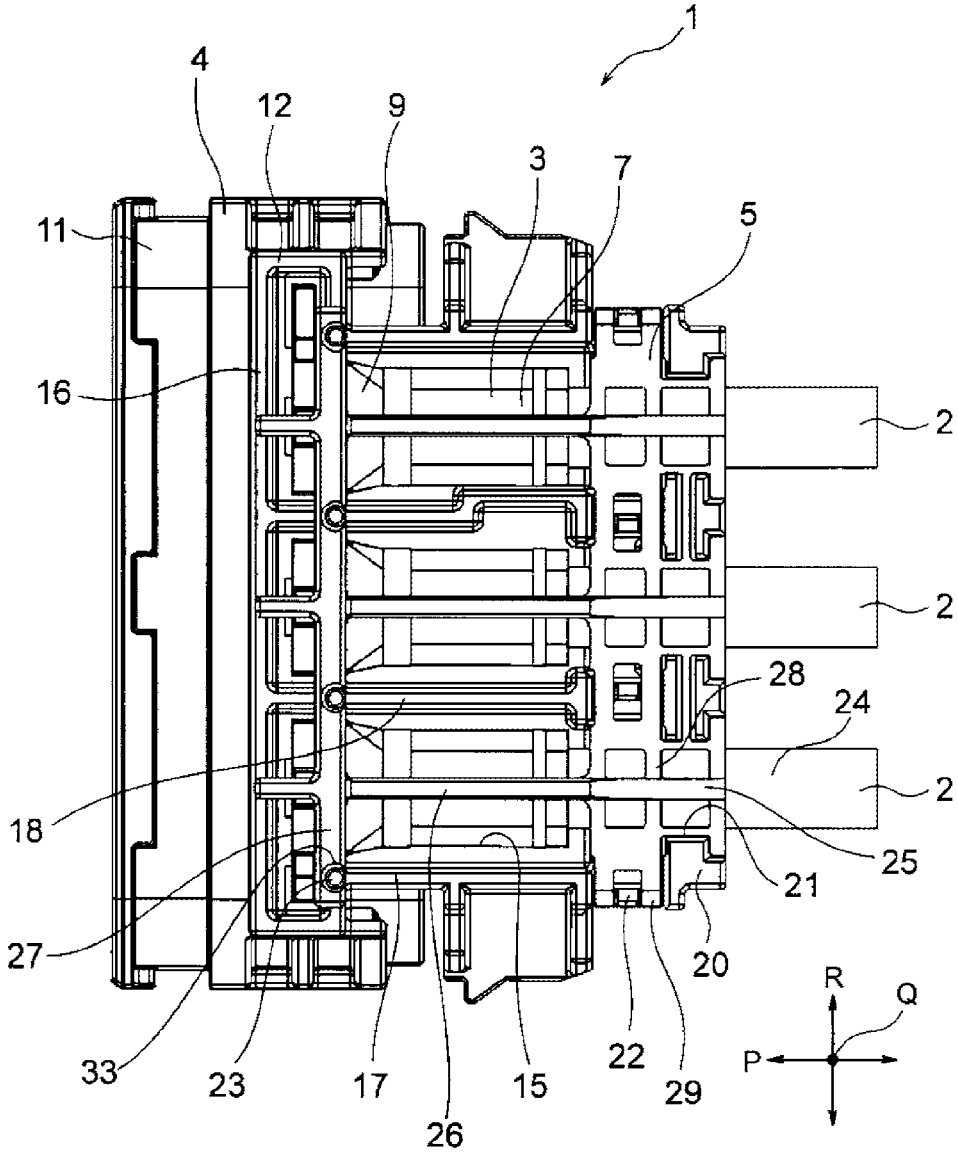
FIG. 3 is a plan view of the connector shown in FIG. 1.
Figure 4:
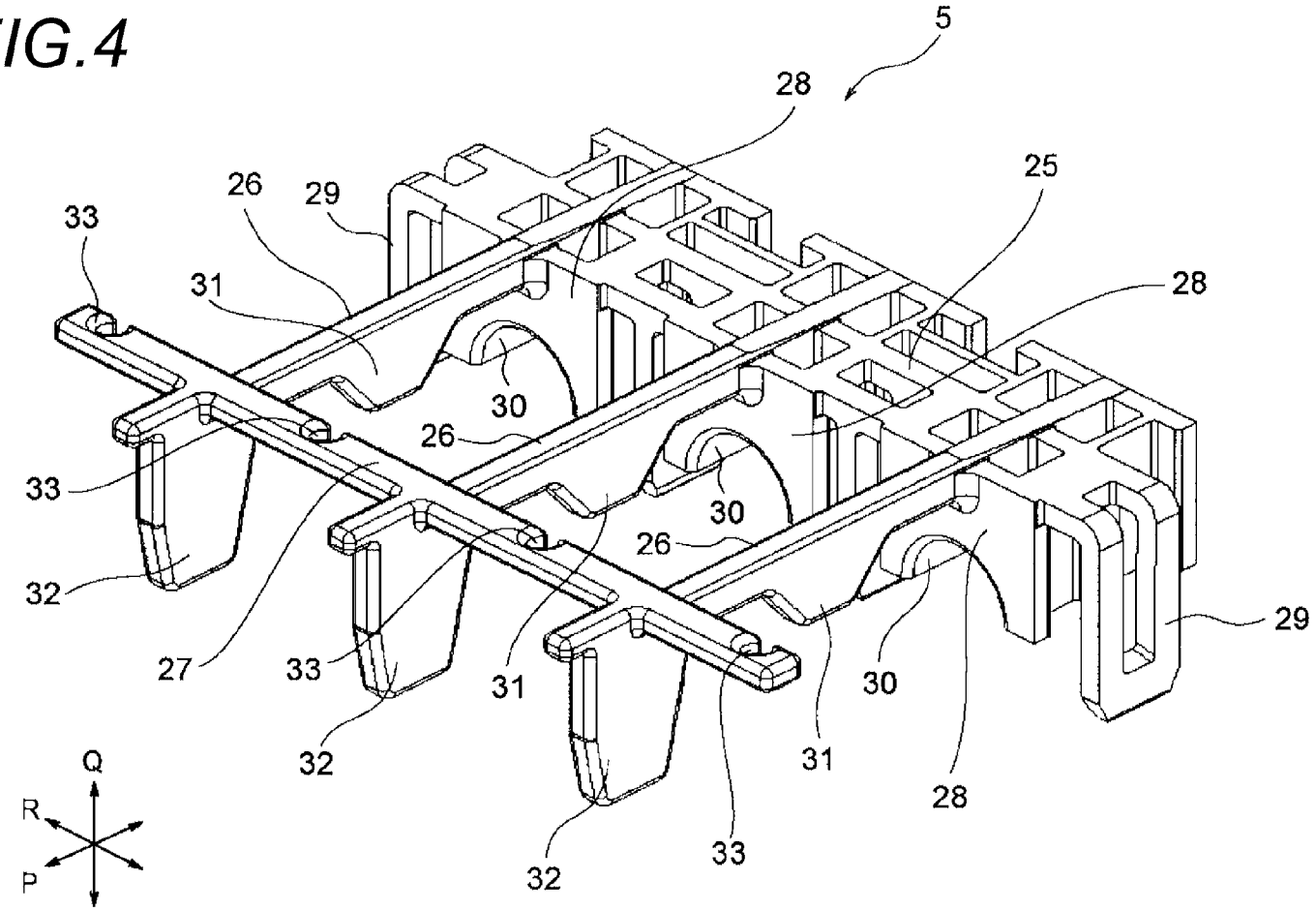
FIG. 4 is a perspective view of a holder shown in FIG. 1.

In FIGS. 1 to 3, the connector housing 4 is a resin molding product formed by an injection molding and includes a mating fitting part 11 for a mating housing (not shown), a waterproofing part 12 which is subjected to a waterproofing and an interconnecting part 13 that interconnects the mating fitting part 11 and the waterproofing part 12. Here, the connector housing 4 has a shape shown in the drawings, for example. The mating fitting part 11 is formed so that the electrical contact part 8 of the terminal fitting 3 is exposed to an internal space of the mating fitting part 11.

The terminal accommodation part 14 is provided at the interconnecting part 13 provided between the mating fitting part 11 and the waterproofing part 12. The terminal accommodation part 14 is formed to pass through the interior of the interconnecting part 13. The terminal accommodation part 14 is formed to allow the electrical contact part 8 of the terminal fitting 3 to pass therethrough from the waterproofing part 12 side and also to allow a fitting part (a reference numeral thereof is omitted) of the terminal fitting 3 to be hooked and locked thereto.

The waterproofing part 12 is a part to be subjected to the waterproofing as mentioned above and is provided with a filling chamber 15 for filling the filler. The filling chamber 15 is partitioned by a front wall 16, right and left side walls 17 and two partition walls 18 which are positioned between the right and left side walls 17, where a direction of arrow P is defined as a front-rear direction, a direction of arrow Q is defined as an upper-lower direction and a direction of R is defined as a right-left direction in the drawings. The waterproofing part 12 (the filling chamber 15) is formed to open in a rear side and an upper side and to have a bottom 19. One end of the terminal accommodation part 14 is opened to the bottom 19 in the vicinity of the front wall 16. The waterproofing part 12 (the filling chamber 15) is configured to allow the terminal fitting 3 to be accommodated and mounted through the upper opening. The upper opening is formed in consideration of a shape of the wire connection part 7 and the continuous part 9 of the terminal fitting 3, when seen from a plan view.

A holder fitting part 20 is formed at a rear side of the waterproofing part 12. The holder fitting part 20 is a part into which the holder 5 is fitted. The holder fitting part 20 includes a holder insertion part 21 and a holder locking part 22. The holder insertion part 21 is formed to correspond to a covering engagement part 28 (will be described later) of the holder 5. Further, the holder locking part 22 is a claw-like protrusion and is formed to allow a locking arm part 29 (will be described later) of the holder 5 to be hooked and locked thereto. The holder locking part 22 is arranged on outer surfaces of the right and left side walls 17.

In addition to the above configurations, the waterproofing part 12 includes rib locking parts 23 to which ribs 26 (will be described later) of the holder 5 are locked. The rib locking parts 23 are respectively formed at the right and left side walls 17 and two partition walls 18 at the front side of the waterproofing part 12.

In FIGS. 1 to 4, the holder 5 is a resin molding product formed by the injection molding similarly to the connector housing 4 and includes a holder body 25, a plurality of ribs 26 formed integrally with the holder body 25 and a second rib 27 formed over the plurality of ribs 26. The holder body 25 is fitted into the waterproofing part 12 of the connector housing 4 and engaged with a covering part 24 of the high-voltage electric wire 2 which is drawn from the filling chamber 15. Here, the holder 5 has a shape shown in FIG. 4.

The holder body 25 includes covering engagement parts 28 which are inserted into the holder insertion parts 21 of the connector housing 4 and engaged with the covering part 24 of the high-voltage electric wire 2, and locking arm parts 29 which are hooked and locked to the holder locking parts 22 of the connector housing 4. The covering engagement parts 28 are formed to protrude according to the number of the high-voltage electric wires 2. Semi-cylindrical pressing grooves 30 which are in close contact with the covering part 24 of the high-voltage electric wire 2 are formed at a tip of the covering engagement parts 28. The covering engagement parts 28 and the pressing grooves 30 can be provided for preventing leakage of the filler when the filler is filled into the filling chamber 15. The locking arm parts 29 are formed at positions of both lateral sides of the holder body 25. The locking arm parts 29 are formed in an arm shape which is a substantially frame-shape.

The ribs 26 are formed across an upper opening of the filling chamber 15 and also to extend to a position corresponding to the continuous part 9 (or the wire connection part 7) of the terminal fitting 3. The ribs 26 are arranged so that a gap between the rib 26 and the side wall 17 or the partition wall 18 is narrower than a finger width of an operator. The ribs 26 are provided to prevent an operator from accidentally putting a finger into the filling chamber and also to prevent an operator from touching the filler before being cured which is filled into the filling chamber 15. In addition to the shape of the present embodiment, the ribs 26 may have a lattice shape, for example. In the present embodiment, the ribs 26 are configured so that a tip (free end) thereof is supported on the front wall 16 of the waterproofing part 12.

A lower side of the rib 26 is formed as a filler immersed part 31 (corresponding to a part of the rib described in Claims). The filler immersed part 31 is a part which is immersed in the filler filled into the filling chamber 15 and intended for reducing the filling amount of the filler by an amount corresponding to the immersion. Furthermore, an extension part 32 extending toward the bottom 19 of the filling chamber 15 is integrally formed at a lower side of the rib 26.

The extension part 32 is formed as a part which detects the incomplete-fitting state of the terminal fitting 3. In the present embodiment, the extension part 32 is formed at a position corresponding to the continuous part 9 of the terminal fitting 3. Alternatively, the extension part 32 may be formed at a position corresponding to the wire connection part 7. The extension part 32 is formed as a part for determining that the terminal fitting 3 is in the incomplete-fitting state with respect to the terminal accommodation part 14 if the extension part 32 is brought into contact with the terminal fitting 3 when the holder 5 is fitted into the connector housing 4. Since the extension part 32 protrudes downward beyond the filler immersed part 31, it is possible to reduce the filling amount of the filler by a protruding amount of the extension part 32.

The second rib 27 is formed to keep a gap between the plurality of ribs 26. The second rib 27 is formed with a plurality of locked parts 33 which are locked to the rib locking parts 23 of the connector housing 4.

In the above configuration and structure, when the terminal fitting 3 at the end of the high-voltage electric wire 2 is accommodated in the connector housing 4, the continuous part 9 and the wire connection part 7 of the terminal fitting 3 can be seen through the upper opening of the waterproofing part 12 (the filling chamber 15). Further, at this time, the high-voltage electric wire 2 is drawn through the rear opening of the waterproofing part 12 (the filling chamber 15).

When the holder 5 is fitted into the connector housing 4 (the waterproofing part 12), the high-voltage electric wire 2 is engaged with the covering engagement part 28 of the holder 5 and thus is urged. As the holder 5 is fitted into the connector housing 4, the covering engagement part 28 closes the rear opening of the waterproofing part 12 (the filling chamber 15). Further, as the holder 5 is fitted, the ribs 26 traverse an upper opening of the filling chamber 15.

In such a state, when the filling chamber 15 is filled with the filler by a dispenser, etc., the filler immersed parts 31 of the ribs 26 are immersed in the filler (the immersion state can be recognized when considering the imaginary line A in FIG. 1 as filler). Although it takes some time for the filler (see, imaginary line A) filled into the filling chamber 15 to be cured, there is no disadvantage that fingers of an operator touch the filler, because the ribs 26 of the holder 5 are provided.

Since the holder 5 does not cover the entire upper opening of the filling chamber 15, it is possible to see the filler and thus to confirm whether the curing is completed or not.

Hereinabove, as has been described with reference to FIGS. 1 to 5, according to the connector of the present embodiment, there is an advantage that it is possible to prevent contact of a hand to the filler A. Further, according to the present embodiment, there is an advantage that it is possible to reduce a filling amount of the filler A to thus cut down the cost.

Hereinabove, the present invention has been explained in detail with reference to the particular embodiment. It is obvious, however, for those skilled in the art that various variations and modifications can be applied without departing a spirit and a scope of the present invention.

This application is based on Japanese Patent Application (Patent Application No. 2010-096666) filed on Apr. 20, 2010, the contents of which are incorporated herein by reference.

INDUSTRIAL APPLICABILITY

According to the connector of the present invention, such advantages can be achieved that it is possible to prevent contact of a hand to filler and to reduce a filling amount of the filler to thus cut down the cost.

REFERENCE SIGNS LIST

1: Connector
2: High-voltage electric wire (Electric wire)
3: Terminal fitting
4: Connector housing
5: Holder
6: Fixed part
7: Wire connection part
8: Electrical contact part
9: Continuous part
10: Bolt insertion through-hole
11: Mating fitting part
12: Waterproofing part
13: Interconnecting part
14: Terminal accommodation part
15: Filling chamber
16: Front wall
17: Side wall
18: Partition wall
19: Bottom
20: Holder fitting part
21: Holder insertion part
22: Holder locking part
23: Rib locking part
24: Covering part
25: Holder body
26: Rib
27: Second rib
28: Covering engagement part
29: Locking arm part
30: Pressing groove
31: Filler immersed part (a portion of rib)
32: Extension part
33: Locked part
51: Wire harness
A: Filler

The invention claimed is:

1. A connector, comprising:

a terminal fitting provided at an end of an electric wire; and a connector housing including a terminal accommodation part in which the terminal fitting is accommodated, wherein the connector is to be waterproofed by a filler filled into a filling chamber of the connector housing, the filling chamber is arranged to allow at least a wire connection part and an continuous part which is continuous to an electrical contact part and continuous to the wire connection part in the terminal fitting to be immersed in the filler, and the connector further comprises a holder fitted in the connector housing and engaged with the electric wire which is drawn from the filling chamber, wherein the holder includes a holder body and a plurality of first ribs extending from the holder body, the first ribs being formed integrally with the holder body, and extending across an opening of the filling chamber and partly being immersed in the filler, wherein the holder body includes pressing grooves to be in contact with the electric wire, and each of the plurality of first ribs respectively extends substantially along a widthwise center of a corresponding one of the pressing grooves, and each of the first ribs is formed to extend to a position corresponding to the continuous part or the wire connection part, and an extension part is integrally formed with one of the first ribs, the extension part extending from the partly immersed portion of the one first ribs toward a bottom of the filling chamber so as to contact the continuous part or the wire connection part.

2. The connector according to claim 1, wherein each of the pressing grooves has a semi-cylindrical shape.

3. The connector according to claim 1, wherein the holder further includes a second rib formed across the plurality of first ribs.

4. The connector according to claim 3, wherein ribs including the first ribs and the second rib form a lattice shape across the opening of the filling chamber.

5. The connector according to claim 3, wherein the second rib includes a locked part to be locked to the connector housing.

* * * * *